US008194010B2

(12) United States Patent
Lee

(10) Patent No.: US 8,194,010 B2
(45) Date of Patent: Jun. 5, 2012

(54) ORGANIC LIGHT EMITTING DISPLAY DEVICE AND METHOD OF DRIVING THE SAME

(75) Inventor: Baek-Woon Lee, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 1000 days.

(21) Appl. No.: 11/969,415

(22) Filed: Jan. 4, 2008

(65) Prior Publication Data

US 2008/0180367 A1 Jul. 31, 2008

(30) Foreign Application Priority Data

Jan. 5, 2007 (KR) ..... 10-2007-0001523

(51) Int. Cl.
*G09G 3/30* (2006.01)
*G09G 5/10* (2006.01)

(52) U.S. Cl. ..... 345/77; 345/690

(58) Field of Classification Search ..... 345/76–83, 345/60–72, 87–104, 204–215, 690–699; 315/169.3

See application file for complete search history.

(56) References Cited

U.S. PATENT DOCUMENTS

2001/0048420 A1* 12/2001 Yamamoto et al. ..... 345/89
2002/0057234 A1 5/2002 Ishizuka et al.
2004/0048069 A1* 3/2004 Yamada ..... 428/411.1
2004/0189680 A1* 9/2004 Feng et al. ..... 345/691
2004/0222999 A1* 11/2004 Choi et al. ..... 345/589
2005/0062703 A1* 3/2005 Lee et al. ..... 345/89
2005/0088379 A1* 4/2005 Tsuchida ..... 345/76
2005/0099367 A1* 5/2005 Kang et al. ..... 345/74.1
2005/0116892 A1* 6/2005 Park ..... 345/60
2005/0162361 A1* 7/2005 Chuang et al. ..... 345/89
2005/0168490 A1* 8/2005 Takahara ..... 345/690
2005/0237316 A1* 10/2005 Huang et al. ..... 345/204
2005/0243032 A1 11/2005 Lee
2005/0264492 A1 12/2005 Knapp et al.
2005/0275605 A1* 12/2005 Kwon ..... 345/63

(Continued)

FOREIGN PATENT DOCUMENTS

EP 1469448 10/2004

(Continued)

OTHER PUBLICATIONS

European Search Report for application No. 07025010.5-1228/1942485 dated Feb. 16, 2009.

*Primary Examiner* — Bipin Shalwala
*Assistant Examiner* — Jonathan King
(74) *Attorney, Agent, or Firm* — Cantor Colburn LLP

(57) ABSTRACT

An organic light emitting display which includes a display panel having a pixel cell formed in a region defined by gate lines and data lines perpendicularly crossing each other, a power supply which supplies current to the display panel, a scan driver which supplies a scan signal to a gate line, a data driver which supplies a data voltage to a data line, a timing controller which supplies a control signal to the scan driver and the data driver and an converted pixel data signal to the data driver, a gradation converter which converts a gradation of a pixel data signal inputted and supplies the converted pixel data signal to the timing controller, and a scale parameter generator which generates a scale parameter through the converted pixel data signal and supplies the scale parameter to the gradation converter, when the next pixel data signal is inputted to the gradation converter.

26 Claims, 5 Drawing Sheets

U.S. PATENT DOCUMENTS

| | | | | |
|---|---|---|---|---|
| 2005/0280611 | A1* | 12/2005 | Abe et al. | 345/74.1 |
| 2005/0285822 | A1* | 12/2005 | Reddy et al. | 345/76 |
| 2005/0285828 | A1* | 12/2005 | Inoue et al. | 345/76 |
| 2006/0007204 | A1* | 1/2006 | Reddy et al. | 345/204 |
| 2006/0077200 | A1 | 4/2006 | Tamayama | |
| 2006/0119553 | A1* | 6/2006 | Akima | 345/77 |
| 2006/0152444 | A1* | 7/2006 | Park | 345/63 |
| 2006/0202934 | A1* | 9/2006 | Shin et al. | 345/95 |
| 2006/0267507 | A1* | 11/2006 | Cho | 315/169.2 |
| 2007/0024563 | A1* | 2/2007 | Oura | 345/98 |
| 2007/0057895 | A1* | 3/2007 | Kong et al. | 345/98 |
| 2007/0103399 | A1* | 5/2007 | Correa et al. | 345/63 |
| 2007/0206031 | A1* | 9/2007 | Yamada | 345/690 |
| 2007/0273677 | A1* | 11/2007 | Kim | 345/204 |
| 2008/0007494 | A1* | 1/2008 | Kim et al. | 345/77 |

FOREIGN PATENT DOCUMENTS

| | | |
|---|---|---|
| EP | 1622119 | 2/2006 |
| JP | 2005316474 | 11/2005 |
| JP | 2006113212 | 4/2006 |
| JP | 2006119465 | 5/2006 |
| WO | 2005088593 | 9/2005 |

* cited by examiner

ORGANIC LIGHT EMITTING DISPLAY DEVICE AND METHOD OF DRIVING THE SAME

This application claims priority to Korean Patent Application No 10-2007-0001523, filed on Jan. 5, 2007, all the benefits accruing therefrom under 35 U.S.C. §119, the contents of which in its entirety is incorporated herein by reference.

BACKGROUND OF THE INVENTION

1. Field of the Invention

The present invention relates to an organic light emitting display device and a method of driving the same. More particularly, to an organic light emitting display device in which an aperture ratio and lifespan are improved.

2. Description of the Related Art

An organic light emitting display device is a type of a fiat panel display device which uses an electroluminescent phenomenon of an organic material. A conventional organic light emitting display device includes an anode and a cathode having an organic light emitting layer injected therebetween. When an electrical current is applied to the anode and the cathode, electrons and holes are transferred to the organic emitting layer and are recombined, so that light is emitted by recombination energy of electrons and holes.

Unlike a non-emissive type display device such as a liquid crystal display ("LCD") device, an organic tight emitting display device does not require a light source and is small in volume and light in weight. An organic light emitting display device is driven with low electrical power, and thus, energy efficiency is high. For these advantages, the organic light emitting device is employed in various electronic devices such as a portable terminal and a large-scale television due to merits of high brightness and high response speed.

An organic light emitting display device is an emissive-type display device and requires a signal line for driving an organic light emitting display panel (hereinafter, "display panel") and a current supplying line for supplying an electrical current for an emission of light. The current supplying line may undergo a voltage drop caused by internal resistance due to a supplied electrical current and may generate high heat since a voltage drop becomes more serious when a high electrical current is applied.

In order to resolve the above problems, a current supplying line for a display panel should have a relatively wide width. However, there is a problem in that an aperture ratio is reduced. If light is emitted with high brightness to compensate a reduced aperture ratio, its lifespan is also reduced.

Further, an area size which a current supplying line and other signal lines overlap is increased, and thus, due to signal interference, a charge state may be poor and spots may appear. Further, a circuit board is attached to an outer region of a display panel to supply a current supplying line with an electrical current, and in order to apply a high electrical current, the attached area size should be larger. Therefore, an outer region of a display panel should be larger, leading to long attaching processing time and high manufacturing costs.

BRIEF SUMMARY OF THE INVENTION

The present invention has made an effort to solve the above stated problems and aspects of the present invention provide an organic light emitting display device and a method of driving the same in which an electrical current supplied to a display panel is restricted based on a reference current value, thereby reducing the width of a current supplying line, leading to a high aperture ratio and a lengthy lifespan.

In an exemplary embodiment, the present invention provides an organic light emitting display device which includes a display panel having gate lines, data lines and pixel cells, a power supply which supplies an electrical current to the display panel, a scan driver which supplies a scan signal to a gate line, a data driver which supplies a data voltage to a data line, a timing controller which supplies a control signal to the scan driver and the data driver, respectively and an converted pixel data signal to the data driver, a gradation converter which converts a gradation of a pixel data signal inputted from an external portion and supplies the converted pixel data signal to the timing controller, and a scale parameter generator which generates a scale parameter through the converted pixel data signal and supplies the scale parameter to the gradation converter when the next pixel data signal is inputted to the gradation converter.

According to an exemplary embodiment, the display panel further includes first and second current supplying lines which are formed respectively parallel with the gate lines and data lines, are electrically connected to each other, and which supply an electrical current from the power supply.

According to an exemplary embodiment, the line width of the first and second current supplying lines includes a range of approximately 12 μm to approximately 67 μm.

According to an exemplary embodiment, each pixel cell includes a first transistor which is electrically connected to the gate and data lines and is turned on whenever the scan signal is applied, a storage capacitor which is electrically connected to the first transistor and the current supplying line and charges a data voltage supplied from the first transistor, and a second transistor which is electrically connected to the storage capacitor and the current supplying line and controls the amount of an electrical current supplied from the current supplying line according to the data voltage discharged from the storage capacitor.

According to an exemplary embodiment, the gradation converter multiplies the pixel data signal inputted from an external portion by the scale parameter supplied from the scale parameter generator to supply the converted pixel data signal.

According to an exemplary embodiment, the scale parameter generator includes a current calculator which adds a total sum of the gradation-converted pixel data signals inputted from the gradation converter to supply a total current value, a current comparator which compares the total current value of the current calculator to a reference current value, a first scale parameter output portion which outputs a scale parameter which includes a smaller value than a scale parameter calculated from previous frame data when the total current value is larger than the reference current value, and a second scale parameter output portion which outputs a scale parameter which includes a larger value than a scale parameter calculated from previous frame data when the total current value is smaller than the reference current value.

According to an exemplary embodiment, the scale parameter generator includes a current calculator which adds a total sum of the gradation-converted pixel data signals inputted from the gradation converter to supply a total current value, a first current comparator which compares the total current value to an upper limit reference current value having a larger value than the reference current value at a boundary of the reference current value, a second current comparator which compares the total current value to a lower limit reference current value having a lower value than the reference value at a boundary of the reference current value, a first scale parameter output portion which outputs a scale parameter which has a smaller value than the scale parameter when the total current value is larger than the upper limit reference current value, a second scale parameter output portion for outputting a scale parameter which has a larger value than the scale parameter when the total current value is smaller than the lower limit reference current value, and a third scale parameter output portion for outputting the scale parameter when the total current value includes a value between the upper and lower limit reference current values.

According to an exemplary embodiment, the reference current value includes a value of approximately 15% to approximately 80% of a maximum value of the pixel data signal inputted from the external portion.

According to an exemplary embodiment, the organic light emitting display device further includes a second gradation converter which is formed between the gradation converter and the timing controller which converts the pixel data signal converted in the gradation converter to a pixel data signal of red, green, blue and white.

The scale parameter generator generates the scale parameter through the pixel data signal of red, green, blue and white supplied from the second gradation converter and supplies the scale parameter to the gradation converter.

The gradation converter multiplies the pixel data signal inputted from the external portion by the scale parameter supplied from the scale parameter generator to output the converted pixel data signal.

The scale parameter generator includes a current calculator which adds a total sum of the gradation-converted pixel data signals inputted from the gradation converter, to supply a total current value, a current comparator which compares the total current value of the current calculator to a reference current value, a first scale parameter output portion which outputs a scale parameter which includes a smaller value than a scale parameter calculated from previous frame data when the total current value is larger than the reference current value, and a second scale parameter output portion which outputs a scale parameter which includes a larger value than a scale parameter calculated from previous frame data when the total current value is smaller than the reference current value.

The scale parameter generator includes a current calculator which adds a total sum of the gradation-converted pixel data signals inputted from the gradation converter to supply a total current value, a first current comparator which compares the total current value to an upper limit reference current value having a larger value than the reference current value at a boundary of the reference current value, a second current comparator which compares the total current value to a lower limit reference current value having a lower value than the reference value at a boundary of the reference current value, a first scale parameter output portion which outputs a scale parameter which includes a smaller value than the scale parameter if the total current value is larger than the upper limit reference current value, a second scale parameter output portion which outputs a scale parameter which includes a larger value than the scale parameter when the total current value is smaller than the lower limit reference current value, and a third scale parameter output portion which outputs the scale parameter when the total current value includes a value between the upper and lower limit reference current values.

In another exemplary embodiment, the present invention provides a method for driving an organic light emitting display device, the method includes, multiplying, via a gradation converter, a pixel data signal inputted from an external portion by a scale parameter generated through a pixel data signal of a previous frame and supplying a gradation-converted pixel data signal to a timing controller, generating a scale parameter through the converted pixel data signal supplied from the gradation converter, supplying the gradation-converted pixel data signal to a data driver, via the timing controller, converting, via the data driver, a data voltage of the gradation-converted pixel data signal and supplying the data voltage to a display panel when a scan signal is supplied from a scan driver, supplying, via a power supply, a power signal to first and second current supplying lines, and supplying the power signal to an organic light emitting diode of the display panel.

According to an exemplary embodiment, generating the scale parameter includes adding a total sum of the gradation-converted pixel data signals from the gradation converter, to generate a total current value, comparing the total current value to a reference current value, supplying a scale parameter having a smaller value than the scale parameter of the previous frame to the gradation converter when the total current value is larger than the reference current value, and supplying a scale parameter having a larger value than the scale parameter of the previous frame to the gradation converter when the total current value is smaller than the reference current value.

According to an exemplary embodiment, the method for driving an organic light emitting display device further includes setting an upper limit reference current value which is larger than the reference current value and a lower limit reference current value which is smaller than the reference current value, at a boundary of the reference current value, comparing the total current value to the upper limit reference current value, supplying the scale parameter having a smaller value than the scale parameter of the previous frame to the gradation converter when the total current value is larger than the upper limit reference current value, and comparing the total current value to the lower limit reference current value when the total current value is smaller than the upper limit reference current value, and supplying the scale parameter having a larger value than the scale parameter of the previous frame to the gradation converter when the total current value is smaller than the lower limit reference current value, and supplying the scale parameter of the previous frame to the gradation converter when the total current value is larger than the lower limit reference current value.

According to an exemplary embodiment, the method for driving an organic light emitting display device further includes converting, via the gradation converter, the gradation-converted pixel data signal to a pixel data signal of red, green and blue.

According to an exemplary embodiment, the method for driving an organic light emitting display device further includes supplying the pixel data signal of red, green and blue to the scale parameter generator.

According to an exemplary embodiment, generating the scale parameter includes adding a total sum of the gradation-converted pixel data signals from the gradation converter to generate a total current value, comparing the total current voltage to a reference current value, supplying a scale parameter having a smaller value than the scale parameter of the previous frame to the gradation converter when the total current value is larger than the reference current value, and supplying a scale parameter having a larger value than the scale parameter of the previous frame to the gradation converter when the total current value is smaller than the reference current value.

According to an exemplary embodiment, the method for driving an organic light emitting display device further includes setting an upper limit reference current value which is larger than the reference current value and a lower limit reference current value which is smaller than the reference current value, at a boundary of the reference current value, comparing the total current value to the upper limit reference current value, supplying the scale parameter having a smaller value than the scale parameter of the previous frame to the gradation converter when the total current value is larger than the upper limit reference current value, and comparing the total current value to the lower limit reference current value when the total current value is smaller than the upper limit reference current value, and supplying the scale parameter having a larger value than the scale parameter of the previous frame to the gradation converter when the total current value is smaller than the lower limit reference current value, and supplying the scale parameter of the previous frame to the gradation converter when the total current value is larger than the tower limit reference current value.

According to an exemplary embodiment, the reference current value is set to approximately 15% to approximately 80% of a maximum consumption current value of the display panel.

According to an exemplary embodiment, the upper limit reference current value includes a value between the reference current value and a value which is 20% larger than the reference current value, and the lower limit reference current value includes a value between the reference current value and a value which is 20% smaller than, the reference current value.

According to an exemplary embodiment the scale parameter includes a value between 0 and 1.

BRIEF DESCRIPTION OF THE DRAWINGS

The above and/or other aspects, features and advantages of the present invention will become more apparent from the following detailed description when taken in conjunction with the accompanying drawings, in which.

DETAILED DESCRIPTION OF THE INVENTION

Figure 1:
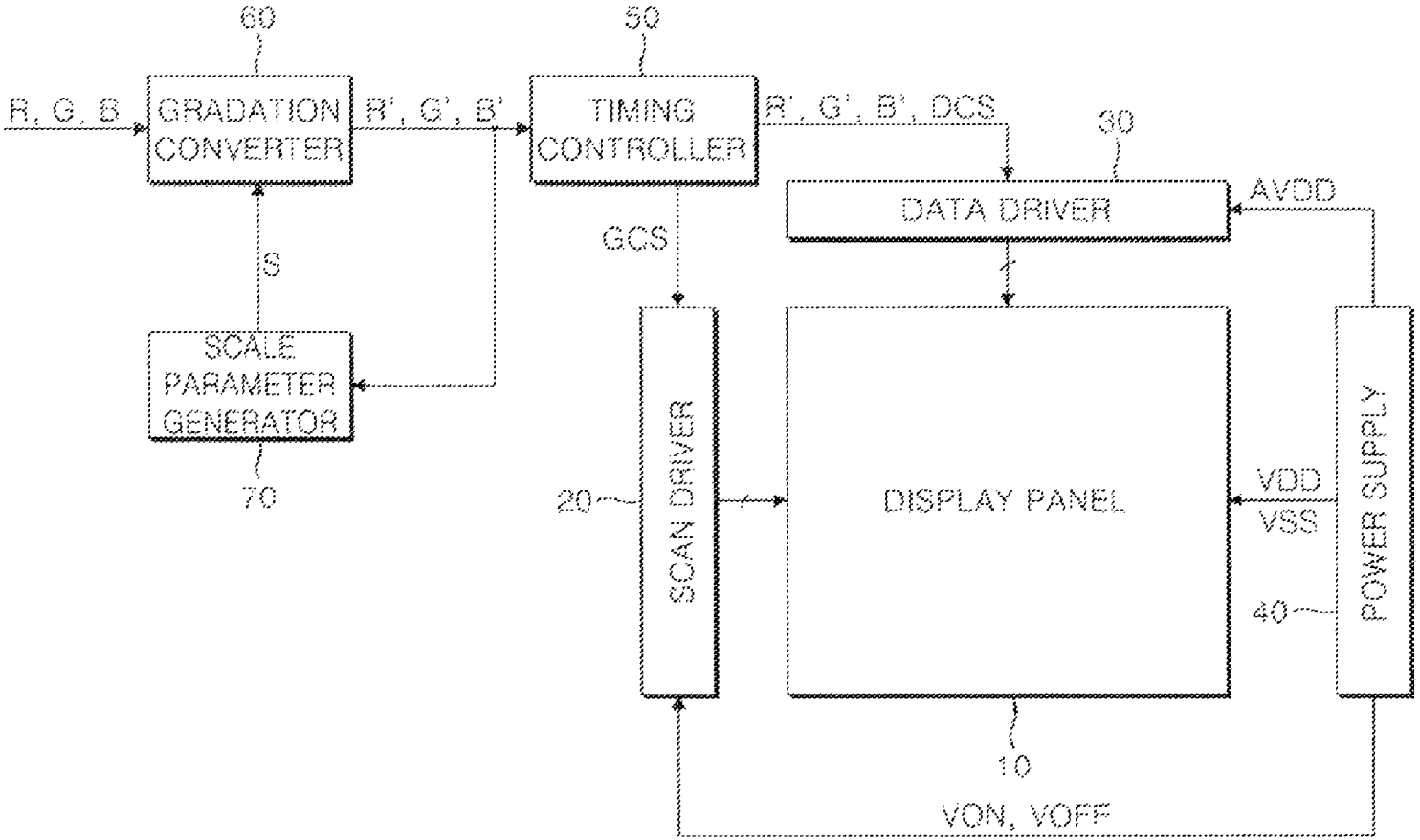
FIG. 1 is a block diagram illustrating an exemplary embodiment of an organic light emitting display device according to the present invention.

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and ail combinations of one or more of the associated listed items.

If will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise, It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another elements) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which, this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

Figure 2:
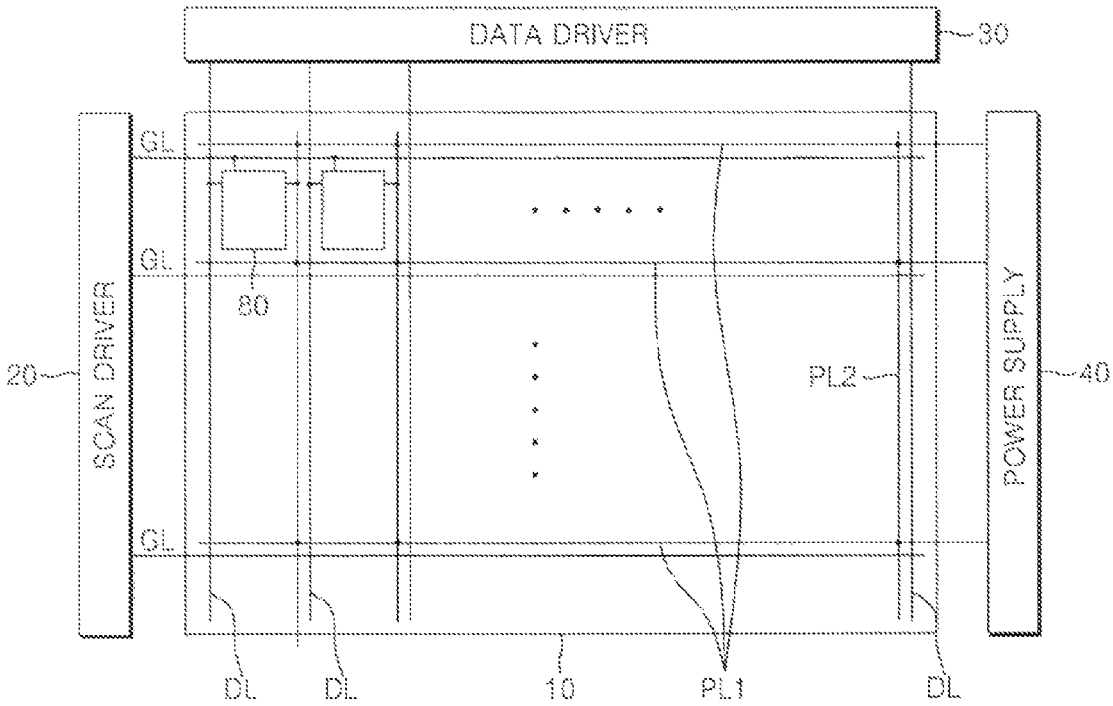
FIG. 2 is a plan view illustrating an exemplary embodiment of a display panel of the organic light emitting display device of FIG. 1, according to the present invention.
Figure 3:
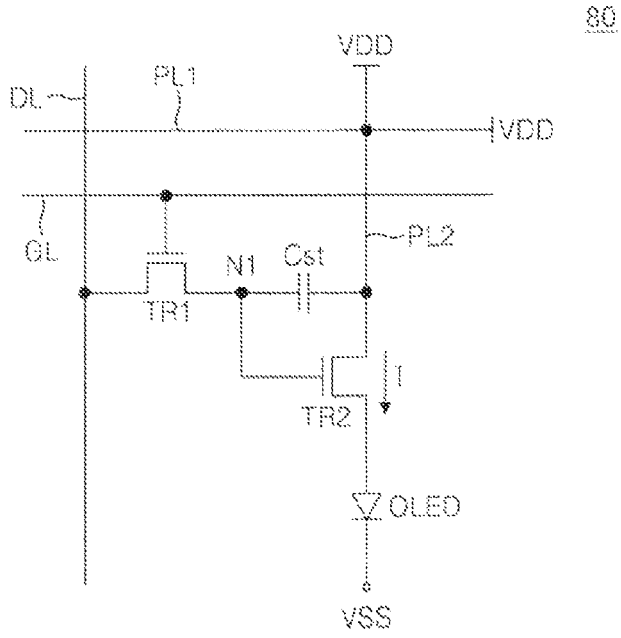
FIG. 3 is a circuit diagram illustrating an exemplary embodiment of an equivalent circuit of a pixel ceil of the organic light emitting display device of FIG. 2, according to the present invention.

FIG. 1 is a block diagram illustrating an exemplary embodiment of an organic light emitting display device according to the present invention, FIG. 2 is a plan view illustrating an exemplary embodiment of a display panel of the organic light emitting display device of FIG. 1, and FIG. 3 is a circuit diagram illustrating an exemplary embodiment of an equivalent circuit of one pixel cell of the organic light emitting display device of FIG. 2.

Referring to FIGS. 1 through 3, the organic light emitting display device according to an exemplary embodiment of the present invention includes a display panel 10, a scan driver 20, a data driver 30, a gradation converter 60, a timing controller 50, a scale parameter generator 70.

The display panel 10, as shown in FIG. 2, includes gate lines GL arranged in a transverse direction, data lines DL arranged in a vertical direction substantially perpendicular to the gate lines GL, a plurality of pixel cells 80 arranged at crossing points of the gate lines GL and the data lines DL, and a plurality of first and second current supplying lines PL1 and PL2 which supply an electrical current to the pixel ceils 80.

The gate line GL applies a scan signal supplied from the scan driver 20 to the pixel cell 80.

The data line DL is formed to cross the gate line GL and applies a data voltage supplied from the data driver 30 to the pixel cell 80.

The first current supplying line PL1 is arranged parallel with the gate line GL, and the second current supplying line PL2 is arranged parallel with the data line DL. That is, the first and second current supplying lines PL1 and PL2 are formed to cross each other and are electrically connected to each other at crossing points. The pixel cell 80 is supplied with an electrical current through a plurality of current supplying channels such as the first and second current supplying lines PL1 and PL2. Therefore, even if the line width of the first and second current, supplying lines PL1 and PL2 is reduced, a voltage drop which may occur in the first and second current supplying lines PL1 and PL2 can be prevented.

In an exemplary embodiment, the first and second current supplying lines PL1 and PL2 include a line width of approximately 12 μm to 67 μm. When the first and second current supplying lines PL1 and PL2 include a line width of approximately 12 μm, an electrical current supplied from a power supply 40 is restricted to approximately 1.9 Ampere (A), whereas when the first and second current supplying lines PL1 and PL2 include a line width of approximately 67 μm, an electrical current supplied from the power supply 40 is restricted to approximately 10.2 Ampere (A).

According to an exemplary embodiment, the pixel cell 80, as shown in FIG. 3, includes an organic light-emitting diode OLED, first and second transistors TR1 and TR2 which control the organic light-emitting diode OLED, and a storage capacitor Cst which charges a data voltage supplied to the first transistor TR1.

According to an exemplary embodiment, the first transistor TR1 is turned on in response to a scan signal supplied to the gate line GL to supply a data voltage supplied from the data line DL to a first node N1. The storage capacitor Cst charges a data voltage supplied to the first node N1. The second transistor TR2 is in an ON state until a data voltage charged in the storage capacitor Cst is discharged to supply a power signal VDD supplied from the first and second current supplying lines PL1 and PL2 to the organic light-emitting diode OLED. In an exemplary embodiment, the first and second transistors TR1 and TR2 are formed of any one of NMOS and PMOS transistors.

According to an exemplary embodiment, the organic light-emitting diode OLED includes an anode and a cathode having an organic light emitting layer (not shown) interposed therebetween. According to an exemplary embodiment, the anode is formed on a substrate of the display panel 10 and is made of an opaque conductive material or an opaque metal. The cathode is formed, opposite to the anode, and is made of a transparent conductive material. The organic light emitting layer includes light-emitting materials to generate red light, green light and blue light. The organic light emitting layer further includes a hole injecting layer (not shown), a hole transporting layer (not shown), a light-emitting layer (not shown), an electron transporting layer (not shown), and an electron injecting layer (not shown), which are stacked over the anode, consecutively, in order in which they are mentioned above. The organic light emitting diode OLED generates light such that the cathode supplies electrons to the light emitting layer through the electron injecting layer and the electron transporting layer, the anode supplies holes to the light emitting layer through the hole injecting layer and the hole transporting layer, and the electrons and the holes are recombined in the light emitting layer which emits light. The anode is electrically connected to an output of the second transistor TR2, and the cathode is electrically connected to a ground voltage VSS or a power voltage VSS which includes a lower voltage than a voltage supplied to the anode.

That is, the organic light emitting diode OLED emits light by an electrical current T controlled by the second transistor TR2 according to a data voltage supplied from the first transistor TR1.

According to an exemplary embodiment, the power supply 40 supplies a gate on voltage Von and a gate off voltage Voff to the scan driver 20 and supplies an analog driving voltage AVDD to the data driver 30. The power supply 40 supplies a power signal VDD to the first and second current supplying lines PL1 and PL2. In an exemplary embodiment, the power supply 40 supplies an electrical current of approximately 1.8 A or 10.2 A based on the line width of the first and second current supplying lines PL1 and PL2. The power supply 40 controls the amount of an electrical current supplied according to a reference current value set by the scale parameter generator 70 which controls a total consumption power or consumption current.

The scan driver 20 is synchronized with a gate control signal GCS supplied from the timing controller 50, to sequentially supply a scan signal to the gate line GL The data driver 30 converts pixel data signals R', G' and B' supplied from the timing controller 50 into analog voltages and supplies them to the data line DL.

As mentioned above, the timing controller 50 also supplies the gate control signal GCS to the scan driver 20 to control an output timing of a scan signal. Further, the timing controller 50 supplies a data control signal DCS to the data driver 30. The timing controller 50 supplies pixel data signals R', G' and B' converted by the gradation converter 80 to the data driver 30 with timing.

The gradation converter 60 multiplies the pixel data signals R, G and B inputted from an external portion (not shown) by a scale parameter S supplied from the scale parameter generator 70 to convert their gradation. That is, the gradation converter 60 multiplies the pixel data signals R, G and B of a present frame by a scale parameter S' generated from a pixel data signal of a previous frame by the scale parameter generator 70 to convert gradation of the pixel data signals of the present frame.

The scale parameter generator 70 adds the pixel data signals R', G' and B', compares them with a reference current value and supplies them to the gradation converter 60 when the pixel data signals R, G and B of the present frame are inputted.

Figure 4:
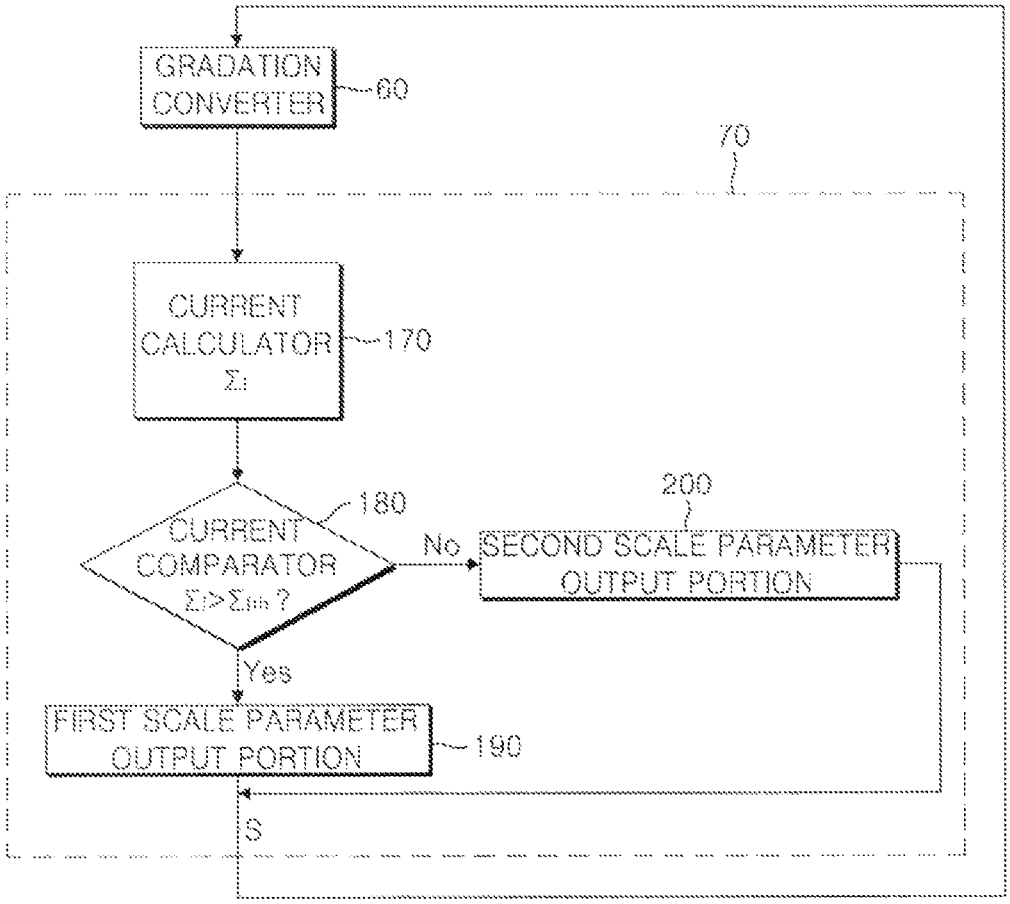
FIG. 4 is a block diagram illustrating an exemplary embodiment of a scale parameter generator according to the present invention.

FIG. 4 is a block diagram illustrating an exemplary embodiment of the scale parameter generator 70 according to the present invention.

Referring to FIG. 4, the scale parameter generator 70 includes a current calculator 170, a current comparator 180, and first and second scale parameter output portions 190 and 200.

The current calculator 170 adds a total sum of the current values included in the data signals R', G' and B' converted by the gradation converter 60 to obtain a total current value (Σ1).

The consumption current or power of the display panel 10 is in proportion to an electrical current supplied to the organic light emitting diode OLED, and an electrical current supplied to the organic light emitting diode OLED is identical to a gamma conversion of a gradation included in the inputted pixel data signals.

Therefore, the current calculator 170 calculates a total current value (Σ1) consumed in the display panel 10 by using one of the following mathematical formulas 1 and 2. For example, one pixel includes pixel cells 80 of red, green and blue, and each pixel cell 80 includes one organic light emitting diode. A total current value (Σ1) consumed in the pixel cells 80 of the display panel 10 during one frame can calculated by adding all gradation information of the pixel cells 80 by using the mathematical formula 1:

$$\Sigma 1 = R^y + G^y + B^y \qquad \text{Formula1,}$$

where y denotes a constant having the range of approximately 1.8 to 3.

In the display panel 10, there may be a case where it is difficult to calculate the amount of an electrical current when the constant y includes a value other than an integer, for example 2.2. Also, there may be a case where a gamma curve is not driven exactly according to an exponential function when a black and a white of the display panel 10 are driven. For this reason, the total current value (Σ1) consumed in the display panel 10 can be calculated by a sum of gamma functions by using the mathematical formula 2;

$$\Sigma 1 = \Gamma(R) + \Gamma(G) + \Gamma(B) \qquad \text{Formula 2.}$$

According to an exemplary embodiment the total current value (Σ1)calculated by the formula 1 or 2 is stored in a memory (not shown) in the form of a lookup table. The lookup table is formed such that a gradation value of a pixel is matched with a current value.

The current comparator 180 compares the total current value (Σ1) calculated by the current calculator 170 to a reference current value (Σ1th) which is previously set, According to an exemplary embodiment, the reference current value (Σ1th) is set to a lower value than a maximum consumption current value, which is set when the display panel 10 is designed. In an exemplary embodiment, the reference current value (Σ1th) includes a value of approximately 15% to approximately 80% of the maximum consumption current value.

When the total current value (Σ1) is larger than the reference current value (Σ1th), the scale parameter S is outputted from the first scale parameter output portion 190, The scale parameter S outputted from the first scale parameter output portion 190 includes a lower value than the scale parameter S' calculated from previous frame data. For example, the scale parameter S outputted from the first scale parameter output portion 190 is scaled-down before outputted by a mathematical formula3:

$$S = S' - \frac{1}{N}. \qquad \text{Formula 3}$$

When the total current value (Σ1) is smaller than the reference current value (Σ1th), the scale parameter S is outputted from the second scale parameter output portion 200. The scale parameter S outputted from the second scale parameter output portion 200 is scaled-up before outputted, by a mathematical formula 4:

$$S = S' + \frac{1}{N}. \qquad \text{Formula 4}$$

For example, when a data signal of a high gradation is inputted as two-step previous frame data, a data signal of a low gradation as one-step previous frame data, and a data signal of a low gradation as present frame data, an electrical current is applied having a very low value even in a low gradation since the scaled-down data are inputted as the present frame data, so that brightness is lowered. Therefore, when the total current value (Σ1) is smaller than the reference current value (Σ1th), a scale parameter S which is sequentially scaled-up is supplied to thereby prevent brightness from being lowered in a low gradation. Here, the scale parameter S is adjusted to be larger than "0" and equal to or less than 1.

In the formulas 3 and 4, N is a constant. According to an exemplary embodiment, when a driving frequency of the organic light emitting display device is 60 Hz. N includes a value between 32(=$2^5$) and 1024(=$2^{10}$). According to another exemplary embodiment, when the driving frequency of the organic light emitting display device is increased twice, for example to 120 Hz, a range of an N value is increased twice. That is, when the driving frequency of the organic light emitting display device is 120 Hz, N is set to a value between 64(=$2^6$) and 2048(=$2^{11}$). Hereinafter, it is assumed that the organic light emitting display device is driven at a frequency of 60 Hz. Here, when N is less than 32, the scale parameter S is changed to a very large value for each frame, and it affects the display quality. If N is larger than 1024, a variation of the scale parameter S becomes very small, so that it is difficult to sufficiently control the amount of an electrical current used in the display panel 10. For this reason, according to an exemplary embodiment, N is set to a value between 32 and 1024. According to the current exemplary embodiment, N is set to 256(=$2^8$), For example, when N is set to 256 and the total current value (Σ1) in the display panel 10 is larger than the reference current value (Σ1th), a value obtained by subtracting 1/256 from a previous scale parameter S' is outputted as the scale parameter S, Therefore, the scale parameter S does not change steeply but steadily, thereby preventing a sudden change of brightness of the display panel 10 and display inferiority such as flickering.

Even though an electrical current larger than the reference current value (Σ1th) is momentarily supplied so that an electrical current is increased in the organic light-emitting diode OLED, the amount of an electrical current is naturally controlled by internal resistances of the first and second current supplying lines PL1 and PL2 formed in the display panel 10. At this time, heat is generated in the first and second current supplying lines PL1 and PL2, hut the amount of an electrical current becomes smaller than the reference current value (Σ1th) in the next frame or later, whereby heat generation does not last.

Meanwhile, when in the process of generating the scale parameter S, the total current value (Σ1) is at a boundary of the reference current value (Σ1th) and a noise exists in the display panel, the scale parameter S may unnecessarily change in each frame. If the scale parameter S unnecessarily changes, a moving picture which is artificially produced may be unstably played. In order to prevent this phenomenon, as shown in FIG. 5, the reference current value (Σ1th) includes an upper limit and a lower limit, and the fixed scale parameter S is outputted.

Figure 5:
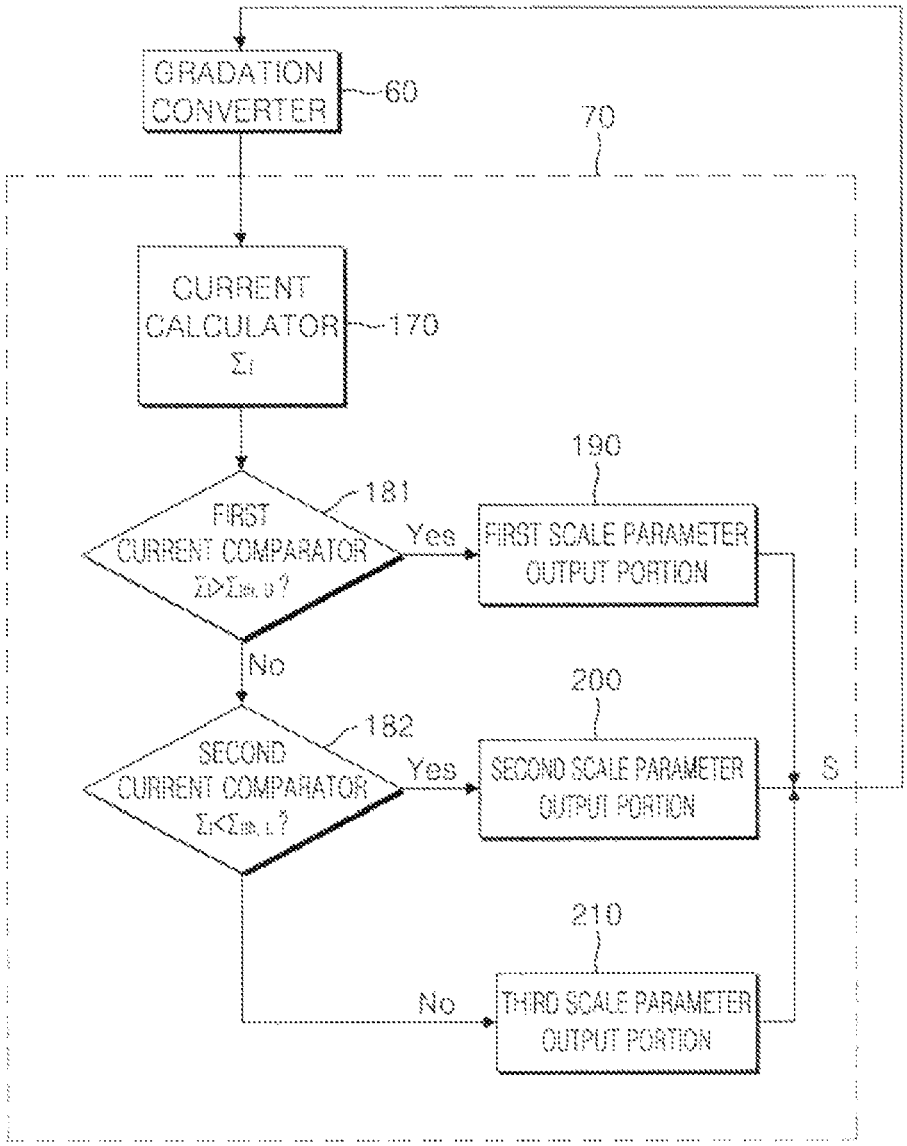
FIG. 5 is a block diagram illustrating another exemplary embodiment of a scale parameter generator according to the present invention.

FIG. 5 is a block diagram illustrating another exemplary embodiment of the scale parameter generator 70 according to the present invention.

Referring to FIG. 5, the scale parameter generator 70 includes a current calculator 170, first and second current comparators 181 and 182, and first, second and third scale parameter output portions 190, 200 and 210.

The scale parameter generator 70 compares the total current value (Σ1) inputted from the current calculator 170 with the upper limit (Σ1th,U) of the reference current value (Σ1th) through the first comparator 181. When the total current value (Σ1) is larger than the upper limit (Σ1th,U) of the reference current value (Σ1th), the first comparator 181 outputs the scale parameter S calculated by using the formula 3 through the first scale parameter output portion 190. However, when the total current value (Σ1) is not larger than the upper limit (Σ1th,U) of the reference current value (Σ1th), the second comparator 182 compares the total current value (Σ1) to the lower limit (Σ1th, L) of the reference value (Σ1th).

When the total current value (Σ1) is smaller than the lower limit (Σ1th,L) of the reference current value (Σ1th), the second comparator 182 outputs the scale parameter S calculated by using the formula 3 through the second scale parameter output portion 200. On the other hand, when the total current value (Σ1) is not smaller than the lower limit (Σ1th,L) of the reference current value (Σ1th), the second comparator 182 outputs the scale parameter S' of the previous frame "as is" through the third scale parameter output portion 210.

The scale parameter generator 70 supplies the scale parameter S' of the previous frame "as is" to the gradation converter 60 when the inputted total current value (Σ1) is between the upper limit (Σ1th,U) of the reference current value (Σ1th) and the lower limit (Σ1th,L) of the reference current value (Σ1th). Therefore, it is possible to prevent the scale parameter S from unnecessarily changing.

In an exemplary embodiment, the upper limit (Σ1th,U) of the reference current value (Σ1th) is set based on the reference current value (Σ1th) and is set to within a value which is approximately 20% larger than the reference current value (Σ1th), and the lower limit (Σ1th,L) of the reference current value (Σ1th) is set based on the reference current value (Σ1th) and is set to within a value which is approximately 20% smaller than the reference current value (Σ1th). According to the current exemplary embodiment, the upper limit (Σ1th,U) is set to within a value which is approximately 5% larger than the reference current value (Σ1th), and the lower limit (Σ1th, L) is set to within a value which is approximately 5% smaller than the reference current value (Σ1th), The upper and lower limits (Σ1th,U) and (Σ1th,U) may are set according to the amplitude of a noise component of the display panel.

In the current exemplary embodiment, the first and second comparators 181 and 182 and the first, second and third scale parameter output portions 190, 200 and 210 may be realized by an operator of a single process operator or a block of a software program.

According to an exemplary embodiment, the organic light emitting display device controls an electrical current supplied to the display panel 10 to reduce the line width of the first and second current supplying lines PL1 and PL2. The amount of an electrical current supplied from the power supply 40 to the first and second current supplying lines PL1 and PL2 is decreased to reduce the power consumption of the display panel 10. Also, since the line width of the first and second current supplying lines PL1 and PL2 is reduced, an aperture ratio is increased, and since the amount of an electrical current supplied to the organic light-emitting diode OLED is reduced, a lifespan is increased.

Figure 6:
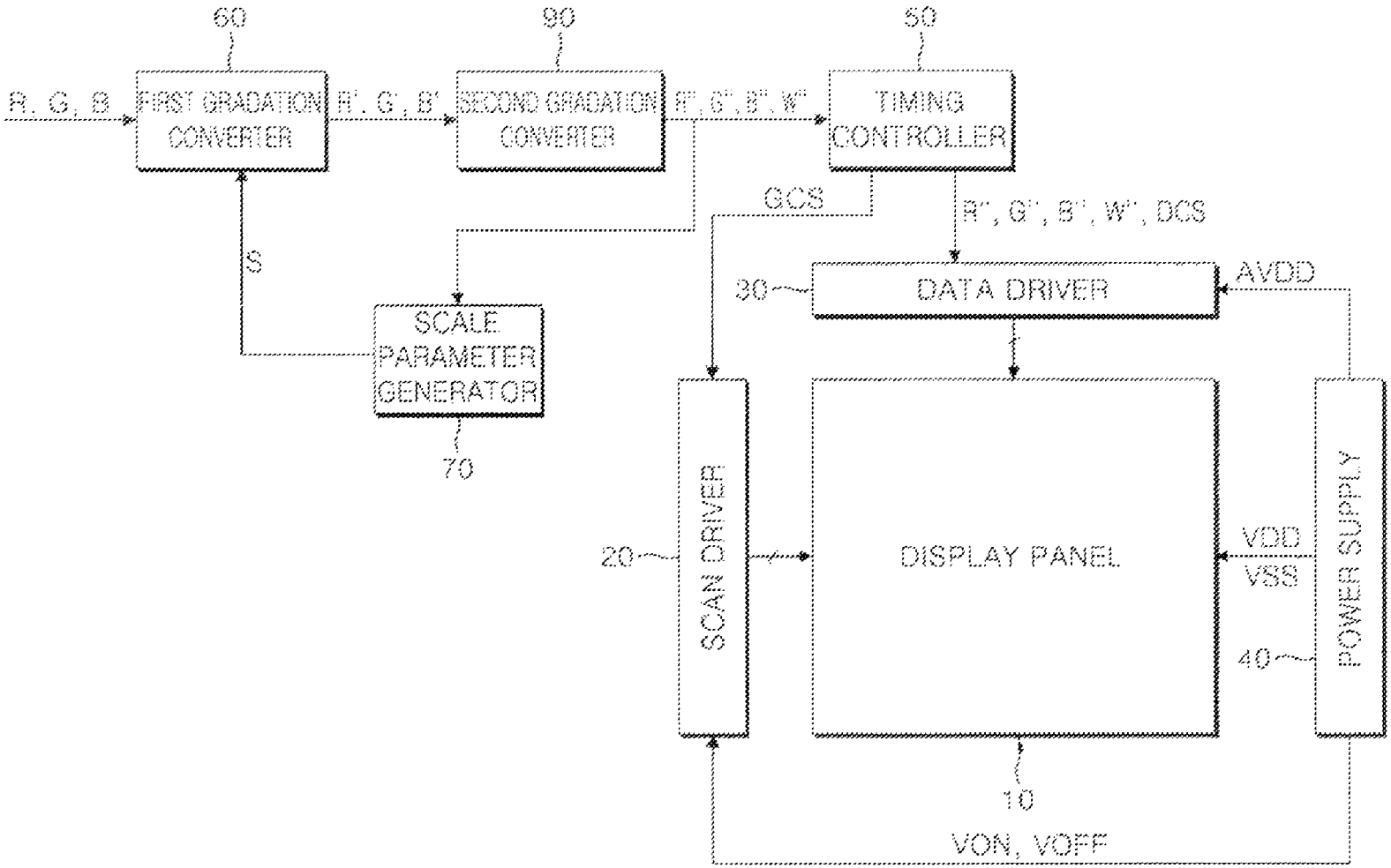
FIG. 6 is a block diagram illustrating another exemplary embodiment of an organic light emitting display device according to the present invention.

FIG. 6 is a block diagram illustrating another exemplary embodiment of an organic light emitting display device according to the present invention.

The organic light emitting display device disclosed in FIG. 6 is different from that of FIG. 1, in that the organic light emitting display device of FIG. 8 includes a first gradation converter 60, and a second gradation converter 90 which converts pixel data signals R', G' and B' of red, green and blue Into pixel data signals R", G", B" and W" of red, green, blue and white. In FIGS. 1 and 6, like reference numerals denote like, parts, and thus duplicated descriptions on those parts are omitted.

Referring to FIG. 6, the organic light emitting display device according to the current exemplary embodiment of the present invention includes a display panel 10 having an organic light-emitting diode OLED, a scan driver 20 which drives a gate line GL, a data driver 30 which drives a data line DL, a first gradation converter 60 which multiplies pixel data signals R, G and B inputted from an external portion (not shown) by a scale parameter S supplied from the scale parameter generator 70, to be converted to pixel data signals R', G' and B', the second gradation converter 90 converts the pixel data signals R', G' and B' of red, green and blue into pixel data signals R", G", B" and W" of red, green, blue and white, a timing controller 50 which supplies a gate control signal GCS and data control signal DCS to the scan driver 20 and the data driver 30, respectively, and supplies the pixel data signals R", G", B" and W" supplied from the second gradation portion 90 to the data driver 30, and the scale parameter generator 70 generates a scale parameter S through the pixel data signals R", G", B" and W" of the previous frame supplied from the second gradation converter 90.

The second gradation converter 90 generates the pixel data signals R", G", B" and W" of red, green, blue and white through the pixel data signals R', G' and B' of red, green and blue whose gradations are converted by the first gradation converter 60. The second gradation converter 90 supplies the pixel data signals R", G", B" and W" of red, green, blue and white to the timing controller 50 and the scale parameter generator 70.

The timing controller 50 supplies the pixel data signals R", G", B" and W" supplied from the second gradation converter 90 to the data driver 30 according to the data control signal DCS.

The scale parameter generator 70 calculates a total current value (Σ1) of one frame through the pixel data signals R", G", B" and W" of red, green, blue and white supplied from the second gradation converter 90 and compares it with a reference current value (Σ1th) to generate a scale parameter S to be supplied to the first gradation converter 60. In the current embodiment, a current calculator 170 of the scale parameter generator 70 calculates the total current value (Σ1) of the display panel 10 by using mathematical formulas 5 and 6. The formulas 5 and 6 additionally have parameters for a white pixel data signal W" compared to the formulas 1 and 2, and thus duplicated descriptions are omitted. In an exemplary embodiment, the current calculator 170 calculates the total current to be consumed in the display panel by using the formula 6.

$$\Sigma 1 = R^{\gamma} + G^{\gamma} + B^{\gamma} + W^{\gamma} \quad \text{Formula 5.}$$

$$\Sigma 1 = \Gamma(R) + \Gamma(G) + \Gamma(B) + \Gamma(W) \quad \text{Formula 6.}$$

The scale parameter generator 70 of FIG. 6 includes a similar or same configuration as that of FIGS. 4 and 5, and therefore a description thereof is omitted.

The organic light emitting display devices according to the exemplary embodiments of the present invention include low current consumption and an improved aperture ratio as shown in Table 1 below.

Table 1 illustrates a maximum supply current 1 to be supplied from the power supply 40, the line width of the first and second current supplying lines PL1 and PL2, a ratio (%) of the display area size of the display panel 10 to the area size of the first and second current supplying lines PL1 and PL2. an aperture ratio (%), and a lifespan improvement (%) which are obtained when the reference current value (Σ1th) is changed to a value of approximately 15% to approximately 80% of the maximum consumption current.

TABLE 1

| Reference current value (%) | Maximum supply current (A) | Line width of PL1 and PL2 (μm) | Area size ratio of PL1 and PL2 (%) | Aperture ratio (%) | Lifespan improvement (%) |
|---|---|---|---|---|---|
| 100 | 12.5 | 83 | 16.3 | 43 | 0 |
| 80 | 15 | 66.4 | 13.0 | 46.3 | 16 |
| 50 | 6.25 | 41.5 | 8.1 | 51.1 | 41 |
| 25 | 3.125 | 20.75 | 4.1 | 55.4 | 65 |
| 15 | 1.875 | 12.45 | 2.4 | 56.8 | 75 |

Referring to Table 1, when the reference current value is restricted to 80% of the total consumption current of the display panel 10, the maximum supply current is 10A, whereby the line width of the first and second current supplying lines PL1 and PL2 is reduced from 80 μm to 66.4 μm. As a result, the area size ratio that the first and second current supplying lines PL1 and PL2 occupy in the display panel 10 is reduced from 16.3% to 13%, whereby the aperture ratio is increased from 43% to 46.3%. Also, the lifespan can be improved about 16% by restricting the current '1' supplied to the organic light-emitting diode. Here, if the reference current value (Σ1th) is equal to or more than 80% of the maximum consumption current, the maximum supply current supplied from the power supply 40 to the first and second current supplying lines PL1 and P12 is equal to or more than 10A, so that the effect of the aperture ratio and lifespan improvement is not large since the line width of the first and second current supplying lines PL1 and PL2 is increased Therefore, in the current exemplary embodiment, the reference current value (Σ1th) is equal to or less than 80% of the total consumption current of the display panel 10.

When the reference current value is restricted to 15% of the total consumption current, the maximum supply current is 1.875 A, whereby the line width of the first and second current supplying lines PL1 and PL2 is reduced from 83 μm to 12.45 μm. As a result, the area size ratio that the first and second current supplying lines PL1 and PL2 occupy in the display panel 10 is reduced from 16.3% to 2.4%, whereby the aperture ratio is increased from 43% to 56.8%. Also, the lifespan can be improved about 75% by restricting the current 1 supplied to the organic light-emitting diode OLED. Therefore, since the amount of an electrical current used in the display panel 10 is reduced, the power consumption is reduced. However, if the reference current value (Σ1th) is lowered to less than 15% of the maximum consumption current, an electrical current supplied to the first and second current supplying lines PL1 and PL2 is so small, that the whole brightness of the display panel 10 is reduced. Therefore, according to the current exemplary embodiment, the reference current value includes a value between 15% and 80% of the total consumption current of the display panel 10.

As described above, according to an exemplary embodiment, an electrical current supplied to the display panel 10 is restricted to less than the reference current value (Σ1th) which is in a range of 15% to 80% of the maximum consumption current of the display panel 10, thereby reducing the line width of the current supplying line PL2 which supplies a driving voltage of the organic light-emitting diode OLED and improving the aperture ratio. Also, since the line width of the current supplying line PL2 is reduced, the contact area size between the current supplying line PL2 and the circuit board (not shown) is reduced, whereby the process for contacting the current supplying line PL2 and the circuit board is simplified, leading to a low manufacturing cost.

Furthermore, since an electrical current used in the display panel 10 is reduced, the power consumption is low. Besides, since the amount of an electrical current supplied to the organic light-emitting diode OLED is reduced, the calorific value of the organic light-emitting, diode OLED is reduced, thereby improving the lifespan.

While the present invention has been shown and described with reference to some exemplary embodiments thereof, it should be understood by those of ordinary skill in the art that various changes in form and details may be made therein without departing from the spirit and the scope of the present invention as defined in the appending claims.

What is claimed is:

1. An organic light emitting display device, comprising:

a display panel which comprises gate lines, data lines, and pixel cells;

a power supply which supplies an electrical current to the display panel;

a scan driver which supplies a scan signal to the gate line;

a data driver which supplies a data voltage to the data line;

a first gradation converter which receives a pixel data signal from an external source and multiplies the pixel data signal by a scale parameter to supply a converted pixel data signal to a timing controller;

the timing controller supplying a control signal to the scan driver and the data driver, respectively, and the converted pixel data signal to the data driver; and a scale parameter generator which generates the scale parameter based on a comparison between a total current value of the converted pixel data signal of a prior frame and a reference current value.

2. The organic light emitting display device of claim 1, wherein the display panel further comprises first and second current supplying lines which are formed respectively parallel with the gate lines and data lines, are electrically connected to each other, and supply an electrical current from the power supply.

3. The organic light emitting display device of claim 2, wherein a line width of the first and second current supplying lines comprises a range of approximately 12 μm to approximately 67 μm.

4. The organic light emitting display device of claim 3, wherein each pixel cell comprises:

a first transistor which is electrically connected to the gate lines and data lines and is turned on when the scan signal is applied;

a storage capacitor which is electrically connected to the first transistor and the current supplying line and charges a data voltage supplied from the first transistor; and a second transistor which is electrically connected to the storage capacitor and the current supplying line and controls an amount of an electrical current supplied from the current supplying line according to the data voltage discharged from the storage capacitor.

5. The organic light emitting display device of claim 1, wherein the scale parameter generator comprises:

a current calculator which adds a total sum of the gradation-converted pixel data signals inputted from the first gradation converter, to supply the total current value;

a current comparator which compares the total current value of the current calculator to the reference current value;

a first scale parameter output portion which outputs a scale parameter having a smaller value than a scale parameter calculated from previous frame data when the total current value is larger than the reference current value; and a second scale parameter output portion which outputs a scale parameter having a larger value than a scale parameter calculated from previous frame data when the total current value is smaller than the reference current value.

6. The organic light: emitting display device of claim 1, wherein the scale parameter generator comprises:

a current calculator which adds a total sum of the gradation-converted pixel data signals inputted from the first gradation converter, to supply the total current value;

a first current comparator which compares the total current value to an upper limit reference current value having a larger value than the reference current value at a boundary of the reference current value;

a second current comparator which compares the total current value to a lower limit reference current value having a lower value than the reference current value at a boundary of the reference current value;

a first scale parameter output portion which outputs a scale parameter having a smaller value than the scale parameter calculated when the total current value is larger than the upper limit reference current value;

a second scale parameter output portion which outputs a scale parameter which has a larger value than the scale parameter when the total current value is smaller than the lower limit reference current value; and a third scale parameter output portion which outputs the scale parameter when the total current value includes a value between the upper and lower limit reference current values.

7. The organic light emitting display device of claim 1, wherein the reference current value comprises a value of approximately 15% to approximately 80% of a maximum value of the pixel data signal inputted from the external portion.

8. The organic light emitting display device of claim 7, wherein the scale parameter is larger than 0 and less than 1.

9. The organic light emitting display device of claim 1, further comprising; a second gradation converter which is operably coupled between the first gradation converter and the timing controller, which converts the converted pixel data signal supplied by the first gradation converter to a pixel data signal of red, green, blue and white.

10. The organic light emitting display device of claim 9, wherein the scale parameter generator generates the scale parameter through the pixel data signal of red, green, blue and white supplied from the second gradation converter, and supplies the scale parameter to the first gradation converter.

11. The organic light emitting display device of claim 10, wherein the first gradation converter multiplies the pixel data signal inputted from the external portion by the scale parameter supplied from the scale parameter generator, to output the converted pixel data signal.

12. The organic light emitting display device of claim 11, wherein the scale parameter generator comprises a current calculator which adds a total sum of the gradation-converted pixel data signals inputted from the first gradation converter, to supply the total current value;

a current comparator which compares the total current value of the current calculator to the reference current value;

a first scale parameter output portion which outputs a scale parameter having a smaller value than a scale parameter calculated from previous frame data when the total current value is larger than the reference current value; and a second scale parameter output portion which outputs a scale parameter having a larger value than a scale parameter calculated from previous frame data when the total current value is smaller than the reference current value.

13. The organic light emitting display device of claim 11, wherein the scale parameter generator comprises:

a current calculator which adds a total sum of the gradation-converted pixel data signals inputted from the first gradation converter, to supply the total current value;

a first current comparator which compares the total current value to an upper limit reference current value having a larger value than the reference current value at a boundary of the reference current value;

a second current comparator which compares the total current value to a lower limit reference current value having a lower value than the reference value at a boundary of the reference current value;

a first scale parameter output portion which outputs a scale parameter having a smaller value than the scale parameter when the total current value is larger than the upper limit reference current value:

a second scale parameter output portion which outputs a scale parameter includes a larger value than the scale parameter when the total current value is smaller than the lower limit reference current value; and a third scale parameter output portion which outputs the scale is parameter when the total current value comprises a value between the upper and lower limit reference current values.

14. The organic light emitting display device of claim 13, wherein the scale parameter is larger than 0 and less than 1.

15. A method for driving an organic light emitting display device, the method comprising:

multiplying, via a gradation converter, a pixel data signal inputted from an external portion by a scale parameter generated through a pixel data signal of a previous frame to generate a gradation-converted pixel data signal;

supplying the gradation-converted pixel data signal from the gradation converter to a timing controller;

generating a scale parameter based on a comparison between a total current value of the gradation-converted pixel data signal supplied from the gradation converter and a reference current value;

supplying, via the timing controller the gradation-converted pixel data signal to a data driver;

converting, via the data driver, a data voltage of the gradation-converted pixel data signal and supplying the data voltage to a display panel whenever a scan signal is supplied from a scan driver;

supplying, via a power supply, a power signal to first and second current supplying lines; and supplying the power signal to an organic light emitting diode of the display panel.

16. The method of claim 15, wherein generating the scale parameter comprises:

adding a total sum of the gradation-converted pixel data signals from the gradation converter, to generate the total current value;

comparing the total current value to the reference current value;

supplying a scale parameter having a smaller value than the scale parameter of a previous frame to the gradation converter when the total current value is larger than the reference current value; and supplying a scale parameter having a larger value than the scale parameter of the previous frame to the gradation converter when the total current value is smaller than the reference current value.

17. The method of claim 16, further comprising:

setting an upper limit reference current value which is larger than the reference current value and a lower limit reference current value which is smaller than the reference current value, at a boundary of the reference current value;

comparing the total current value to the upper limit reference current value;

supplying the scale parameter having a smaller value than the scale parameter of the previous frame to the gradation converter when the total current value is larger than the upper limit reference current value, and comparing the total current value to the lower limit reference current value when the total current value is smaller than the upper limit reference current value; and supplying the scale parameter having a larger value than the scale parameter of the previous frame to the gradation converter when the total current value is smaller than the lower limit reference current value, and supplying the scale parameter of the previous frame to the gradation converter when the total current value is larger than the lower limit reference current value.

18. The method of claim 17, wherein the reference current value is set to approximately 15% to approximately 80% of a maximum consumption current value of the display panel.

19. The method of claim 18, wherein the scale parameter comprises a value between 0 and 1.

20. The method of claim 15, further comprising: converting, via the gradation converter, the gradation-converted pixel data signal to a pixel data signal of red, green and blue.

21. The method of claim 20, further comprising: supplying the pixel data signal of red, green and blue to the scale parameter generator.

22. The method of claim 21, wherein generating the scale parameter comprises:

adding a total sum of the gradation-converted pixel data signals from the gradation converter, to generate the total current value;

comparing the total current value to the reference current value;

supplying a scale parameter having a smaller value than the scale parameter of the previous frame to the gradation converter when the total current value is larger than the reference current value; and supplying a scale parameter having a larger value than the scale parameter of the previous frame to the gradation converter when the total current value is smaller than the reference current value.

23. The method of claim 20, further comprising:

setting an upper limit reference current value which is larger than the reference current value and a lower limit reference current value which is smaller than the reference current value, at a boundary of the reference current value;

comparing the total current value to the upper limit reference current value;

supplying the scale parameter having a smaller value than the scale parameter of the previous frame to the gradation converter when the total current value is larger than the upper limit reference current value, and comparing the total current value to the lower limit reference current value when the total current value is smaller than the upper limit reference current value; and supplying the scale parameter having a larger value than the scale parameter of the previous frame to the gradation converter when the total current value is smaller than the lower limit reference current value, and supplying the scale parameter of the previous frame to the gradation converter when the total current value is larger than the lower limit reference current value.

24. The method of claim 23, wherein the reference current value is set to approximately 15% to approximately 80% of a maximum consumption current value of the display panel.

25. The method of claim 24, wherein the upper limit reference current value comprises a value between the reference current value and a value which is 20% larger than the reference current value, and the lower limit reference current value comprises a value between the reference current value and a value which is 20% smaller than the reference current value.

26. The method of claim 25, wherein the scale parameter comprises a value between 0 and 1.

* * * * *